United States Patent [19]

Dürselen

[11] 4,200,020

[45] Apr. 29, 1980

[54] DRAW CUTTER

[75] Inventor: Hans J. Dürselen, Mönchen-Gladbach, Fed. Rep. of Germany

[73] Assignee: Trützschler GmbH & Co. KG, Mönchen-Gladbach, Fed. Rep. of Germany

[21] Appl. No.: 911,813

[22] Filed: Jun. 2, 1978

[30] Foreign Application Priority Data

Jun. 2, 1977 [DE] Fed. Rep. of Germany ..... 2724805

[51] Int. Cl.[2] ..... B26D 5/12

[52] U.S. Cl. ..... 83/643

[58] Field of Search ..... 83/643, 632

[56] References Cited

U.S. PATENT DOCUMENTS

| | | | |
|---|---|---|---|
| 203,441 | 5/1878 | Greenman | 83/643 X |
| 213,089 | 3/1879 | Beck | 83/643 |
| 1,200,802 | 10/1916 | Berry | 83/643 |

FOREIGN PATENT DOCUMENTS

| | | |
|---|---|---|
| 1001851 | 8/1965 | United Kingdom . |
| 1230720 | 5/1971 | United Kingdom . |
| 1337666 | 11/1973 | United Kingdom . |

*Primary Examiner*—Frank T. Yost

*Attorney, Agent, or Firm*—Spencer & Kaye

[57] ABSTRACT

A hydraulically operated cutting machine has a machine frame; a knife bar movably supported on the frame; a hydraulic power cylinder; and a bell crank lever operatively connecting the power cylinder with the knife bar for moving the knife bar into a lower cutting position and a raised position. The bell crank lever is articulated to the machine frame at a fixed center of rotation and the hydraulic cylinder is articulated to the bell crank lever at a first displaceable center of rotation spaced from the fixed center of rotation. An actuating rod is articulated to the knife bar and further to the bell crank lever at a second displaceable center of rotation spaced from the fixed center of rotation. The first and second displaceable centers of rotation travel, respectively, along a first and a second circular path as the bell crank lever pivots about the fixed center of rotation. The centers of rotation are so arranged with respect to one another that in the lower cutting position of the knife bar the second displaceable center of rotation has at least reached its lowermost position along the second circular path.

2 Claims, 2 Drawing Figures

DRAW CUTTER

BACKGROUND OF THE INVENTION

This invention relates to a cutting machine for paper, cardboard, or the like and is provided with a hydraulic drive having a power cylinder which is coupled to the movable knife carrier bar by means of a bell crank lever.

In known cutting machines the dead center of the knife carrier is dependent from the end position of the hydraulic piston and thus depends on the accuracy of switching in the hydraulic system or on the position of abutments. During the cutting operation, the knife has to penetrate a few tenths of a millimeter into the backup support for the material to be cut to ensure, for example, that the lowermost sheet of a paper stack is fully severed throughout its entire width. A continuous or occasional deeper penetration of the knife into the backup support, however, leads to a rapid destruction of the backup support and to a premature loss of the sharpness of the knife. Both occurrences adversely affect the quality of cutting. In order to maintain the depth of penetration of the knife independent from the accuracy of the switching operation, in the known hydraulic cutting machines there is provided a fixed abutment for determining the lower limit position of the knife. The switching operation in such a case is effected automatically by means of the pressure increase in the hydraulic conduit after the abutment has been engaged. It is a disadvantage of this arrangement that the fixed abutment is impacted by the knife carrier at the full hydraulic pressure usually with a well audible blow. The sudden pressure increase in the hydraulic system upon engagement of the knife bar with the abutment or the collision of the piston with the cylinder base involves difficulties concerning the sealing arrangements for the hydraulic system. Further, the forceful impacts cause a high stress and a relatively substantial wear in the joints of the mechanical force-transmitting members between the piston and the knife bar.

SUMMARY OF THE INVENTION

It is an object of the invention to provide a hydraulically operated cutting machine from which the above-discussed disadvantages are eliminated and in which the knife reversing (switching) operation may be effected with high precision.

This object and others to become apparent as the specification progresses, are accomplished by the invention, according to which, briefly stated, the hydraulically operated cutting machine has a machine frame; a knife bar movably supported on the frame; a hydraulic power cylinder; and a bell crank lever operatively connecting the power cylinder with the knife bar for moving the knife bar into a lower cutting position and a raised position. The bell crank lever is articulated to the machine frame at a fixed center of rotation and the hydraulic cylinder is articulated to the bell crank lever at a first displaceable center of rotation spaced from the fixed center of rotation. An actuating rod is articulated to the knife bar and further to the bell crank lever at a second displaceable center of rotation spaced from the fixed center of rotation. The first and second displaceable centers of rotation travel, respectively, along a first and a second circular path as the bell crank lever pivots about the fixed center of rotation. The centers of rotation are so arranged with respect to one another that in the lower cutting position of the knife bar the second displaceable center of rotation has at least reached its lowermost position along the second circular path.

The invention is based on the principle to convert the relatively large and inaccurate hydraulic motions in the zone of the end position of the hydraulic cylinder into short and precise displacements of the actuating rod (which may be a pull rod or a push rod) which is articulated to the knife bar and which transmits the linear motion of the hydraulic piston to the knife bar. Since the direction of motion of the piston is different from that of the knife bar, a bell crank lever is connected between the piston and the pull rod. The bell crank lever is arranged in such a manner that the first center of rotation executes a motion of a relatively short circular path, while the second center of rotation executes a motion along a relatively large circular path about the fixed center of rotation. If now the hydraulic cylinder exerts a tension force on the first center of rotation, the tension force is, by means of the second center of rotation, transmitted to the actuating rod articulated to the knife bar, so that the latter executes a downwardly oriented cutting motion. It is of importance in this connection that in the lowermost cutting position of the knife bar, the second center of rotation assumes its lowest point in its circular path of motion. This lowermost point is determined by a straight line passing through the stationary center of rotation in an orientation perpendicular to the cutting table and further, the lowermost point lies below the fixed center of rotation. While the first center of rotation moves along its circular path substantially in the direction of the hydraulic cylinder, the second center of rotation initially executes along its circular path a motion in the direction of the pull rod and gradually assumes, with a transitional oblique motion, a perpendicular motion with respect to the displacement of the actuating rod. What is of importance is thus the relationship of the directions of motion between the first center of rotation and the hydraulic cylinder, on the one hand, and the second center of rotation and the pull rod, on the other hand. In this manner, it is achieved that despite relatively large and inaccurate displacements of the hydraulic cylinder in the zone of its end position, the actuating rod executes only a smaller and thus a more precise motion. By means of the above arrangement, it is thus possible to eliminate inaccuracies in hydraulic knife drives when the end position is altered.

Preferably, as the knife bar reaches its lowest cutting position, the second center of rotation has already passed the lowest point of its motion about the stationary center of rotation. The return stroke of the knife is then initiated; the return forces are derived, for example, from springs. Expediently, the first center of rotation does not lie on the connecting line between the fixed center of rotation and the second center of rotation; that is, the three centers of rotation constitute the points of a triangle. The centers of rotation are preferably arranged in such a manner on the bell crank lever that the first center of rotation does not reach the connecting line between the fixed center of rotation and the articulation of the hydraulic cylinder. Stated differently, the circular path of the first center of rotation does not, during operation, cross the above-noted connecting line. As a result, the hydraulic cylinder still exerts a tension force on the first center of rotation making it possible that the second center of rotation which has reached the lowest point along its path of motion is capable of passing this point.

The actuating rod between the crank lever and the knife bar may function, dependent upon its structural adaptation, as a pull rod and also as a push rod.

DESCRIPTION OF THE PREFERRED EMBODIMENT

Figure 1:
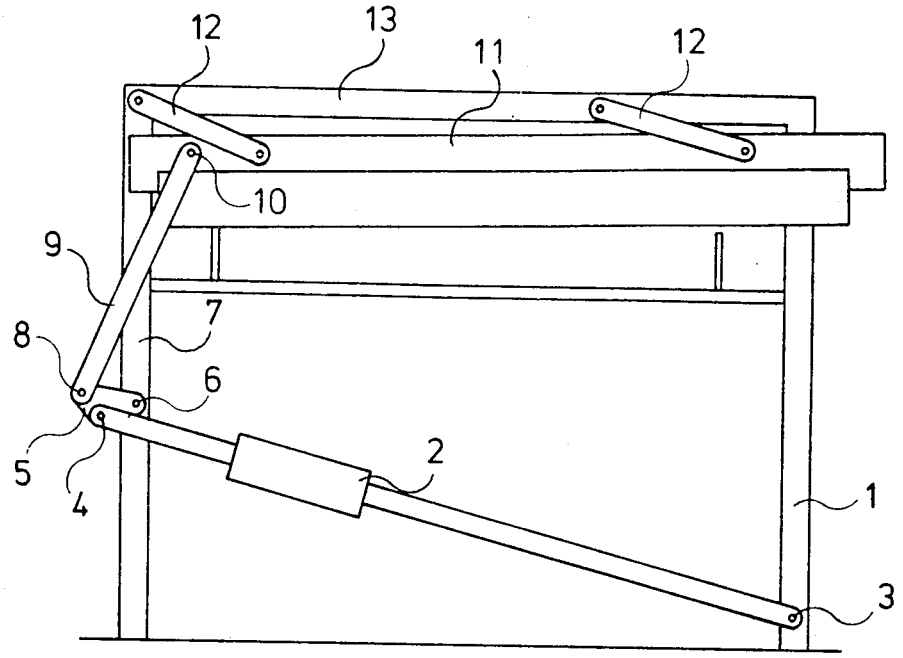
FIG. 1 is a schematic side elevational view of a hydraulically driven cutter, incorporating a preferred embodiment of the invention.

FIG. 1 shows a cutting machine in which to the lower end of an upright 1 of the machine frame there is articulated, at 3, one end of the piston rod of a hydraulic power cylinder 2. The other end of the hydraulic cylinder 2 is articulated to a bell crank lever 5 at a first displaceable center of rotation 4. The bell crank lever 5 is mounted for pivotal motion on an upright 7 of the machine frame at a fixed center of rotation 6 which is located at a level above that of the articulation 3. A pull rod 9 is articulated to a second displaceable center of rotation 8 on the bell crank lever 5. The centers of rotation 4, 6 and 8 form a triangle in which, for example, the side between the centers of rotation 4 and 6 is longer than the side between the centers of rotation 4 and 8. That end of the pull rod 9 which is remote from the bell crank lever 5 is articulated to a knife bar 11 at a displaceable center of rotation 10 which, relative to the center of rotation 6, is arranged between the uprights 1 and 7. The knife bar 11 is articulated to a transverse head beam 13 of the machine frame by means of two links 12. In the raised position of the knife bar 11, the center of rotation 4 is situated below the level of the center of rotation 8.

Figure 2:
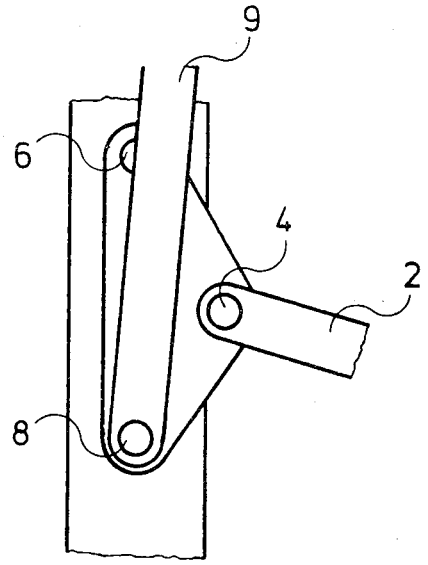
FIG. 2 is an enlarged side elevational view of a detail of FIG. 1 showing the components as a position when the piston of the hydraulic power cylinder unit shown in FIG. 1 is in the zone of an end position.

The direction of motion of the hydraulic cylinder 2 differs from that of the knife bar 11. In the initial position when the knife bar 11 is raised, the displaceable centers of rotation 4 and 8 of the bell crank lever 5 are situated externally of the outline of the machine frame, particularly with respect to the upright 7, as illustrated in FIG. 1. As the hydraulic cylinder 2 is moved in the direction of the articulation 3 on the upright 1 for effecting the cutting operation (that is, for causing a downward motion of the knife bar 11), the bell crank lever 5 is rotated counterclockwise about its center of articulation 6. As will be apparent from a comparison of the different positions of the bell crank lever 5 depicted in FIG. 1 (raised position of the knife bar 11) and FIG. 2 (lowered position of the knife bar 11), the distance between the articulation 3 on the upright 1 and the first displaceable center of rotation 4 is greater in the raised position of the knife bar 11 than in its lower, cutting position. This means that for the cutting stroke the piston rod of the cylinder 2 is submitted solely to a tension (pulling) stress. The first displaceable center of rotation 4 moves along a circular path, passes the upright 7 (that is, passes the vertical extending through the fixed articulation 6) and assumes a position between the uprights 7 and 1, as illustrated in FIG. 2. The first displaceable center of rotation 4 moves along a circular path essentially in the direction of the obliquely arranged hydraulic cylinder 2. Simultaneously, the second displaceable center of rotation 8 moves along a circular path about the fixed center of rotation 6, reaches the upright 7 (that is, reaches the vertical extending through the fixed center of rotation 6) and thereafter, it too assumes a position between the uprights 7 and 1. The motion of the second center of rotation 8 along a circular path occurs initially in essence parallel to the length of the pull rod 9 and then changes into an oblique orientation and thereafter assumes a perpendicular orientation with respect to the displacement of the pull rod 9. The displacement of the center of rotation 8 thus occurs, in the zone of the end position of the hydraulic cylinder 2 approximately in the direction of motion of the obliquely arranged hydraulic cylinder 2, while the motion of the pull rod 9 deviates therefrom. As a result, despite the relatively longer displacement of the hydraulic cylinder 2, the pull rod 9 executes only relatively small displacements. By virtue of the motion of the center of rotation 8, the pull rod 9 exerts a pulling force on the knife bar 11 which, in response, moves downwardly and executes the cutting operation on the material to be cut (not shown). As the second displaceable center of rotation 8 reaches its lowest point along its circular travel about the fixed center of rotation 6 (that is, it reaches its lower dead center) and passes therebeyond, the pulling motion of the pull rod 9 is terminated and the knife bar 11 has reached its lowest cutting position where subsequently the return stroke is initiated.

It is to be understood that the above description of the present invention is susceptible to various modifications, changes and adaptations, and the same are intended to be comprehended within the meaning and range of equivalents of the appended claims.

What is claimed is:

1. In a hydraulically operated cutting machine having a machine frame; a bell crank lever articulated to the machine frame at a fixed center of rotation; a hydraulic power cylinder articulated to the bell crank lever at a first displaceable center of rotation spaced from the fixed center of rotation and further articulated to the machine frame at an additional center of rotation spaced from the bell crank lever; a knife bar movably supported on the frame and having a raised position and a lower, cutting position; and an actuating rod articulated to the knife bar and to the bell crank lever at a second displaceable center of rotation spaced from said fixed center of rotation, whereby an actuation of the hydraulic power cylinder effects motion of the knife bar from its raised position into its cutting position while said first and second displaceable centers of rotation travel, respectively, along a first and a second circular path as said bell crank lever pivots about said fixed center of rotation; the improvement wherein said centers of rotation being so arranged with respect to one another that in said lower cutting position of said knife bar said second displaceable center of rotation has at least reached its lowermost position along said second circular path; and further wherein said bell crank lever has such an orientation with respect to said additional center of rotation that the distance between said first displaceable center of rotation and said additional center of rotation is greater in the raised position of said knife bar than in its cutting position.

2. A hydraulically operated cutting machine as defined in claim 1 wherein a line connecting said additional center of rotation with said fixed center of rotation is free from being crossed by said first circular path.

* * * * *